US006409079B1

(12) United States Patent
Hutchinson

(10) Patent No.: US 6,409,079 B1
(45) Date of Patent: Jun. 25, 2002

(54) PRINT-TO MAIL COMPATIBLE, TWO-WAY SELF-CONTAINED MAILER

(75) Inventor: Wilbur Hutchinson, St. George, UT (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/897,970

(22) Filed: Jul. 5, 2001

(51) Int. Cl.[7] ..... B65D 27/06
(52) U.S. Cl. ..... 229/305; 229/316; 229/92.1
(58) Field of Search ..... 229/316, 305, 229/92.1

(56) References Cited

U.S. PATENT DOCUMENTS

| | | | | |
|---|---|---|---|---|
| 3,652,007 A | | 3/1972 | MacDougall | |
| 4,239,114 A | | 12/1980 | Denay | |
| 4,305,506 A | | 12/1981 | Greenwald | |
| 4,776,510 A | | 10/1988 | Jenkins | |
| 5,513,795 A | | 5/1996 | Sauerwine | |
| 5,860,904 A | * | 1/1999 | Petkovsek | 229/92.1 X |
| 5,890,647 A | * | 4/1999 | Petkovsek | 229/92.1 X |
| 5,950,910 A | * | 9/1999 | Petkovsek | 229/92.1 X |
| 6,015,085 A | | 1/2000 | Cannon et al. | |
| 6,047,880 A | * | 4/2000 | Petkovsek | 229/92.1 X |
| 6,123,255 A | | 9/2000 | Chimera | |
| 6,152,361 A | * | 11/2000 | Abercrombie et al. | 229/305 X |

OTHER PUBLICATIONS

HP LaserJet Print to Mail Accessory Brochure; 6 pages; 2000, No month.

The MOORE Store SealerMate Catalog; 6 pages; No date.

* cited by examiner

*Primary Examiner*—Jes F. Pascua
(74) *Attorney, Agent, or Firm*—Nixon & Vanderhye PC

(57) ABSTRACT

An intermediate for a mailer type business form is provided that is Z-folded to produce a mailer type business form with built-in reply envelope. A large area is provided for printing statement, remittance and/or other information and yet the reply envelope produced accepts a conventional size personal check without folding. Outgoing address indicia is imaged on the top face of the first ply and a first line of demarcation passes through that indicia, so that the indicia can be removed and/or covered when the return envelope flap is folded over to seal the reply envelope. Adhesive patterns for defining the Z-folded mailer and reply envelope are offset to avoid blocking on stacking and are aligned with raised areas of conventional sealing mechanisms.

24 Claims, 5 Drawing Sheets

PRINT-TO MAIL COMPATIBLE, TWO-WAY SELF-CONTAINED MAILER

BACKGROUND AND SUMMARY OF THE INVENTION

Mailer type business forms must serve a wide variety of customer requirements. Several features that are almost universally desirable include the ability to print on a large amount of the mailer, a built-in reply envelope that accepts a conventional size personal check without folding, a statement portion, and a remittance coupon or stub portion for being returned along with the check remittance.

Fourteen-inch, pressure seal Z-fold built-in return envelope products are conventionally imaged on a laser printer in the simplexed mode (one side only). From a print processing standpoint, this is an advantage. However, because the document is simplexed, there is not much space available for variable imaging. These areas generally include room for a statement or invoice, room for a remittance coupon or stub portion, and room to create the return envelope. With conventional three panel documents, one panel is used for the outgoing address panel and the two remaining panels are used to meet the remaining requirements of the mailer. More specifically, on conventional existing pressure seal Z-fold return constructions, the face of the top panel is generally used for both the remittance and the statement or invoice, the middle panel is used to create one side of the return envelope and the bottom is used to create the second side of the return envelope. Pressure seal adhesive or co-adhesive is provided on one and/or the other of the middle panel and bottom panel so that when the Z-fold mailer is formed, the return envelope is simultaneously created. Accordingly, to remit payment, the customer removes the combined statement/remittance portion, severs the remittance stub and inserts it in the reply envelope together with the personal check remittance. A re-wettable adhesive is typically provided on the reply envelope flap, which is folded to the back of the reply envelope to seal the remittance therein.

In the above-described 14 inch, Z-fold return mailer construction, the bottom panel serves a dual purpose. It bears the outgoing address and the side having the outgoing address defines the backside of the return envelope when the mailing is Z-folded. As a result, however, part of the outgoing address is visible on the backside of the return envelope.

It is the primary object of the present invention to provide an intermediate for a mailer, and a mailer, with a great deal of printable area or indicia, as well as a reply envelope, that is readily constructed and utilized. It is a further object of the invention to provide an intermediate having the foregoing characteristics that is compatible with print to mail systems as well as other sealing systems. It is also an object of the invention to provide an intermediate having adhesive patterns and areas that do not substantially overlap when the intermediates are stacked in advance of Z-folding, so that blocking of the sheets is avoided.

According to the present invention, an intermediate for a mailer type business form and the mailer itself are provided which achieves the objectives set forth above. The intermediate comprises a single quadrate sheet of paper, which may be easily run through a printer to print indicia on either one or both faces. In an exemplary embodiment, the outgoing address and the reply address are printed on the same face of the intermediate, and thus is adapted to printing in the simplexed mode. The intermediate may be easily Z-folded to form the final mailer and sealed by conventional techniques.

The mailer is easy to open and the reply envelope is easy to assemble and utilize.

In an exemplary embodiment, the back the three panel document includes opening instructions, for example on the first, top panel; includes a preprinted return address, preferably on the second, middle panel; and in an exemplary embodiment, the third, bottom panel is the back of the return mail piece, on which an advertisement or other information may be provided.

The intermediate for the business form provided according to the invention is imaged in the simplexed mode and then folded and sealed in a conventional manner. When the end user receives the document, one vertical side is removed and then the remainder of the document is opened by breaking adhesive regions defined at the bottom and other vertical side, using a letter opener, index finger, or the like. The folded first and second panels define the retain mailer. A stub portion located at the side of the form is removed to define the back of the return mail piece. The statement and remittance panel is then detached from the return mail piece. The statement can retained, while the remittance portion is filled out and inserted in the reply envelope. A check is then inserted into the return envelope and the envelope is sealed by wetting the adhesive flap of the reply envelope and applying it to the back of the return/reply mail piece.

As is apparent from the foregoing, the invention overcomes a number of barriers and satisfies the requirements of a mailer-type business form. The construction of the invention can be used on all folding/sealing equipment that is currently available. It also allows the check to be placed in the return envelope without folding, which gains wide customer acceptance. Finally, the construction of the invention can be imaged in a simplexed mode, which from a print processing point of view is an advantage, since all variable information can be provided on one face of the intermediate.

Thus, according to one aspect of the present invention, an intermediate for a mailer type business form comprises a quadrate sheet of paper having parallel top and bottom edges, parallel first and second side edges perpendicular to the top and bottom edges, and first and second faces; first and second fold lines parallel to the top and bottom edges, and dividing the sheet into substantially equal size first, second, and third panels; an outgoing address area being defined on the first face of the first panel, the outgoing address area being spaced from the first and second side edges; a reply address area being defined on the first face of the second panel, the reply address area being spaced from the first and second side edges; a remittance area being defined on the first face of the third panel. The sheet of paper is free from a line of weakness adjacent and parallel to the second side edge, thereby to maximize an available space of the first, second and third panels for printed indicia and to define the reply envelope.

A first line of weakness is formed in the first through third panels parallel to and spaced from one of the side edges. This line of weakness defines a tear-off strip providing for ready opening of a mailer constructed by Z-folding the sheet along the fold lines.

First adhesive areas are provided at least in the tear-off strip for holding the first through third panels together as an outgoing mailer when the sheet is Z-folded about the fold lines; and second adhesive areas are provided on the second face of the first and/or second panel for defining the first and second panels into a reply envelope that is substantially sealed along side and top and bottom edges thereof.

A reply envelope closing flap is defined by a portion of the second panel and has an activatable, for example re-wettable, adhesive on the second face thereof for sealing the reply envelope. A line of weakness is formed in the first panel parallel to and spaced from the side edge as to define a removable stub generally corresponding to or slightly larger than the reply envelope closing flap for being removed when the reply envelope is formed.

According to another aspect of the present invention an intermediate for a mailer type business form comprises a quadrate sheet of paper having parallel top and bottom edges, parallel first and second side edges perpendicular to the top and bottom edges, and first and second faces; first and second fold lines parallel to the top and bottom edges, and dividing the sheet into substantially equal size first, second, and third panels; an outgoing address area being defined on the first face of the first panel, the outgoing address area being spaced from the first and second side edges; a reply address area being defined on the first face of the second panel, the reply address area being spaced from the first and second side edges; a remittance area being defined on the first face of the third panel. A first line of weakness is formed in the first, second and third panels, parallel to and spaced from the first side edge, the first line of weakness defining a tear-off strip providing for ready opening of a mailer constructed by Z-folding the sheet about the fold lines. First adhesive areas are provided in the tear-off strip for holding the first through third panels together as an outgoing mailer when the sheet is Z-folded about the fold lines and second adhesive areas are provided on the second face of the first and/or second panel for defining the first and second panels into a reply envelope that is substantially sealed along side and top and bottom edges thereof. A first line of demarcation is disposed parallel to the first line of weakness extending the majority of the dimension of at least the first and second panels parallel to the first line of weakness, the first line of demarcation being closer to the first line of weakness than to the second side edge, and defining a flap in each of the first and second panels between the first line of demarcation and the first line of weakness, the flap in the second panel defining a reply envelope closing flap. A third adhesive area is provided on the second face of the reply envelope closing flap for sealing the reply envelope along an end edge thereof. The first and second adhesive areas of the second face are longitudinally offset with respect to the first adhesive areas of the first face so that upon stacking with a second face of one intermediate disposed to overlie a first face of another intermediate with top edges aligned, the adhesive areas of the first and second faces will not substantially overlap.

In the intermediate as described above, the first line of demarcation may be a line of weakness, at least in the first panel. Further, the reply envelope closing flap dimension from the first line of demarcation to the first line of weakness is, in a preferred embodiment, larger than the dimension of the outgoing address area from the first line of demarcation toward the second side edge, so that when the reply envelope closing flap is folded about the first line of demarcation said second flap sealingly engages the first face of the first panel and the closing flap substantially covers any remaining portion of the outgoing address area.

The longest dimension of the interior of the reply envelope formed from the intermediate is at least about six inches so that the reply envelope can receive an unfolded bank check therein. Also, security screening is typically provided on the second face of the first and second panels to provide confidentiality to the reply envelope.

According to still another aspect of the present invention a mailer type business form is provided comprising the following components: first, second, and third substantially equal size quadrate substantially opaque panels, the second panel being sandwiched between the first and third panels, and each panel having a top face and a bottom face, first and second side edges, and first and second end edges; outgoing address indicia provided on the top face of the first panel; reply address indicia provided on the top face of the second panel; remittance stub indicia provided on the top face of the third panel; a first line of weakness formed in the first, second and third panels, parallel to and spaced from the first side edge thereof, the first line of weakness defining a tear-off strip providing for ready opening of the mailer; first permanent adhesive areas provided in the tear-off strip and at spaced locations along at least a portion of the second side edge holding the first through third panels together; second permanent adhesive patterns provided on the bottom face of the first and second panels defining the first and second panels into a reply envelope that is substantially sealed along three edges thereof; wherein the sheet of paper is free from a line of weakness adjacent and parallel to the second side edge, thereby to maximize an available space of the first, second and third panels for printed indicia and to define the reply envelope.

The reply envelope closing flap dimension from the first line of demarcation to the third line of weakness is preferably larger than the dimension of the outgoing address from the first line of demarcation toward the second side edge, so that when the reply envelope closing flap is folded about the first line of demarcation the second flap sealingly engages the top face of the first flap, the closing flap substantially covering any remaining portion of the outgoing address indicia.

In a preferred embodiment, the mailer further comprises a first line of demarcation disposed parallel to said first line of weakness extending the majority of the dimension of at least said first and second panels parallel to said first line of weakness, said first line of demarcation being closer to said first line of weakness than to said second side edge, and defining a flap in each of said first and second panels between said first line of demarcation and said first line of weakness, said flap in said second panel defining a reply envelope closing flap; and a third adhesive area on said second face of said reply envelope closing flap for sealing the reply envelope along an end edge thereof.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
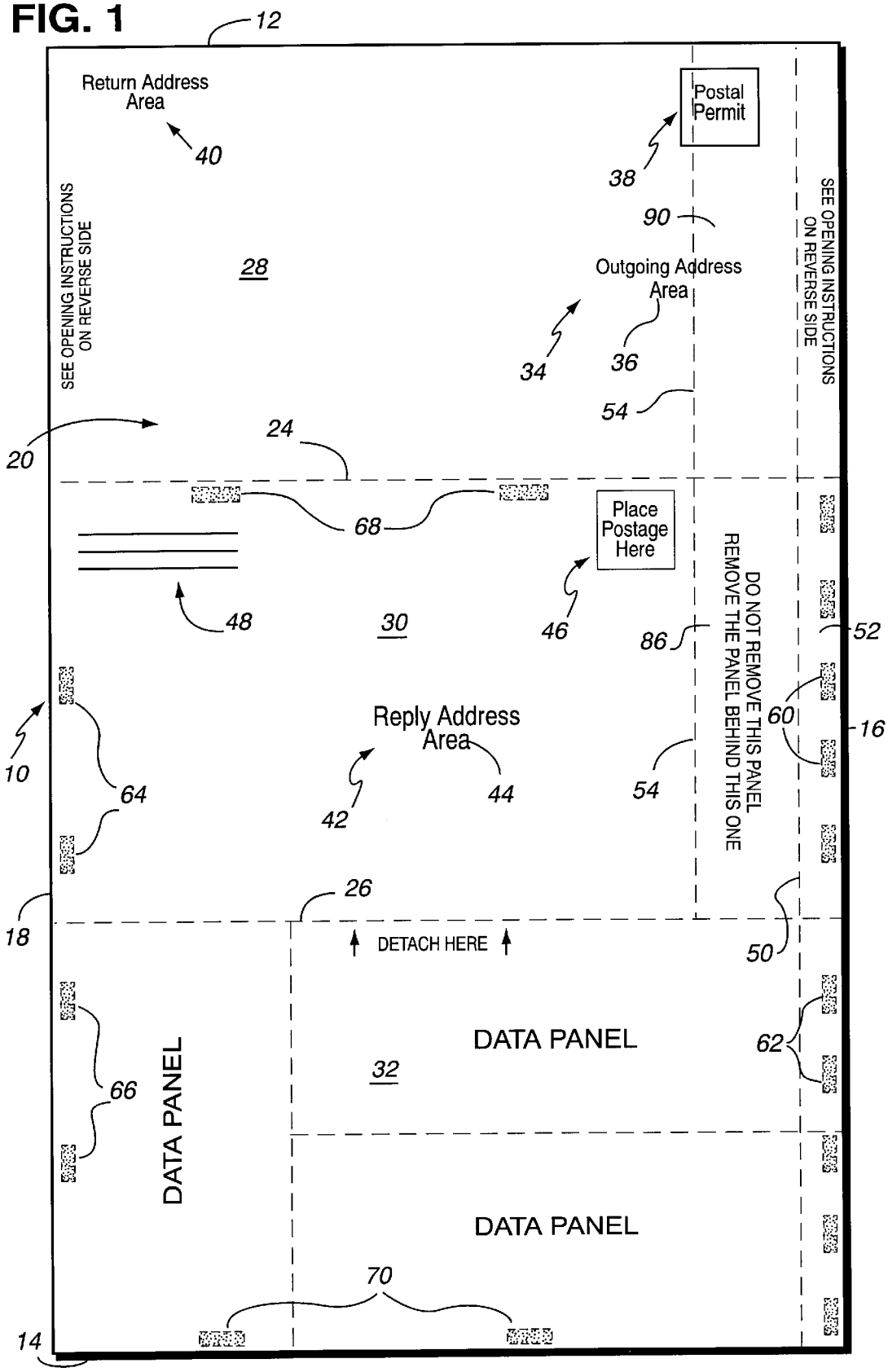
FIG. 1 is a top plan view of a first face of an exemplary intermediate according to the present invention.
Figure 2:
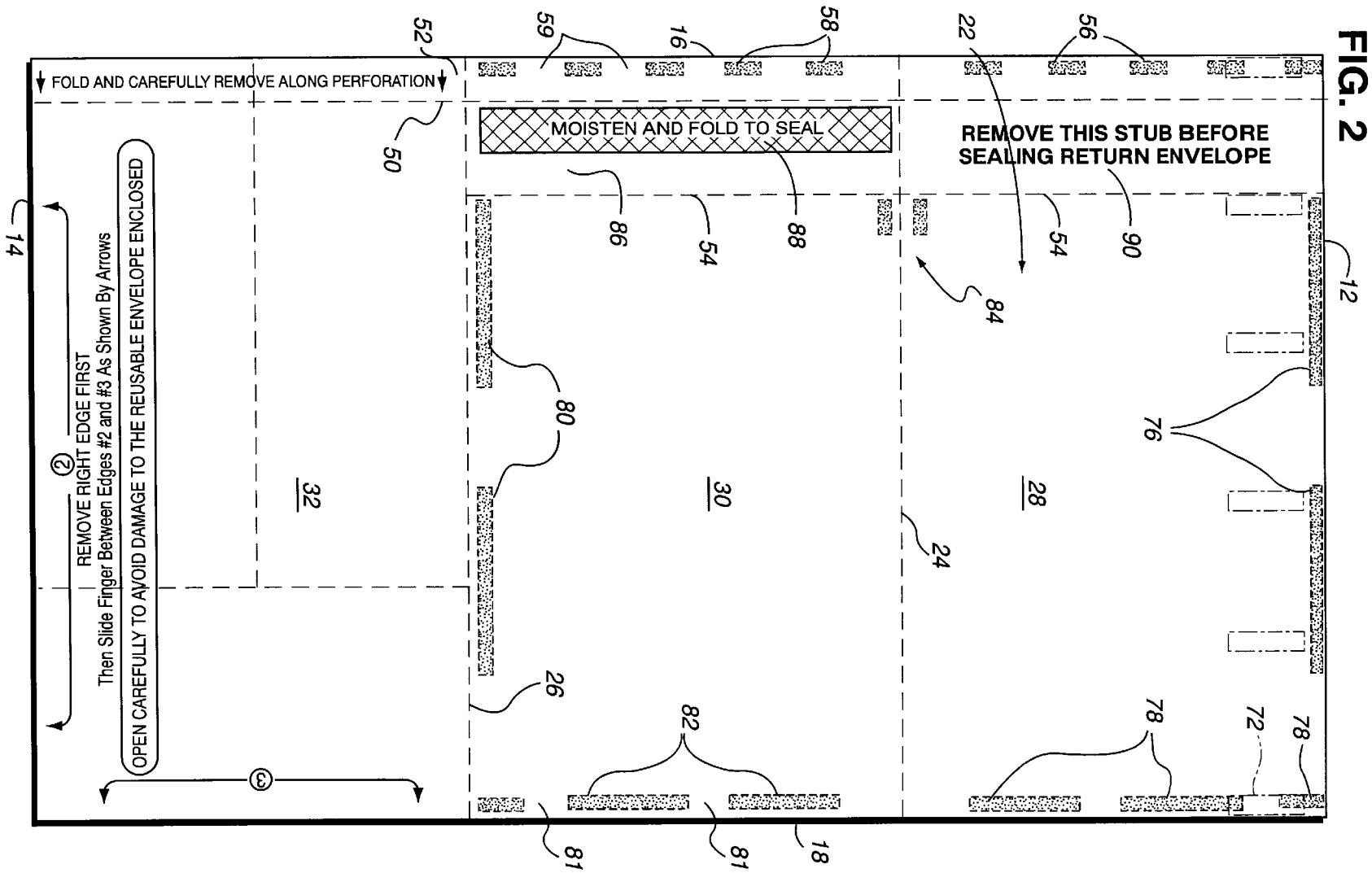
FIG. 2 is a plan view of the second face of the intermediate of FIG. 1.

An exemplary intermediate for a mailer type business form is shown generally by reference number 10 in FIGS. 1 and 2. It includes a quadrate sheet of substantially opaque paper (i.e., no windows and not fully translucent) having parallel top and bottom edges 12,14 and parallel first and second side edges 16, 18, respectively. The side edges are perpendicular to the top and bottom edges. The sheet is further defined to include first and second faces 20, 22 (FIG. 1 and FIG. 2, respectively). First and second fold lines 24, 26 are provided parallel to the top and bottom edges for dividing the sheet of the intermediate into three substantially three-equal size panels 28, 30, 32.

With reference to the presently preferred, illustrated embodiment, the first panel 28 is disposed as the top panel of the form, the second panel 30 is disposed as the middle panel and the third panel 32 is disposed as the bottom panel of the form so that the second panel is between the first and third panels. Thus, the first panel 28 is between the top edge 12 and the first fold line 24, the second panel 30 is between fold lines 24 and 26 and the third panel is between fold line 26 and the bottom edge 14 of the intermediate 10. Fold lines 24, 26 may comprise lines of weakness such as perforation lines or die cut lines or may merely be scored or crease lines. In the presently preferred embodiment where the third panel 32 is adapted to be removed and retained by the end user, the fold line 26 is preferably a line of weakness that facilitates separation of the third panel from the second panel. Furthermore, in the presently preferred embodiment, the first and second panels 28, 30 together define the reply envelope and therefore, the first fold line 24 need not be adapted to be severed by the end user. As will become apparent below, the invention is not limited to the described series and orientation of the panels, except as required by the appended claims.

The intermediate also includes an outgoing address area 34 on the first face 20 of the first panel 28. The outgoing address area is of a size and defined by a media to receive e.g., a laser printed address or preprinted address label. The outgoing address area can include indicia corners or other indicator such as a change in texture, tone or color of the paper to facilitate the determination of the proper location of the outgoing address. Such indicators, however, are not critical to the effective implementation of the invention. Human readable address indicia, as shown only schematically by indicia 36 in FIG. 1, is ultimately imaged on the intermediate such as after it has passed through the laser printer. Other human or machine readable indicia may also be preprinted on the first face of the third panel, such as a postal address bar coding (not shown), indicia 38 for postal stamp/permit application and/or indicia 40 for the sender's return address.

The intermediate also defines a reply address area 42 on the first face 20 of the second panel 30 of intermediate 10. The reply address area 42 is of a size and media suitable for receiving human readable address indicia. Again, corner indicia or other print area designators, as described above with reference to the outgoing address area 34, may be provided to indicate the most preferred location of the reply address. In the presently preferred embodiment, the reply address indicia 44 is preprinted in the reply address area 42 but the indicia may be variably printed thereon or applied as a preprinted address label without departing from the concept of the invention. Thus, at some point, human readable reply address indicia shown schematically at 44 in FIG. 2 is provided in the reply address area 42. Other human or machine readable indicia may also be provided, as by preprinting, on the first face 20 of the second panel 30, such as a postal address bar coding (not shown), indicia for postal stamp application 46 and/or indicia 48, such as blank lines, for the end user to apply their own return address to the reply envelope.

Figure 4:
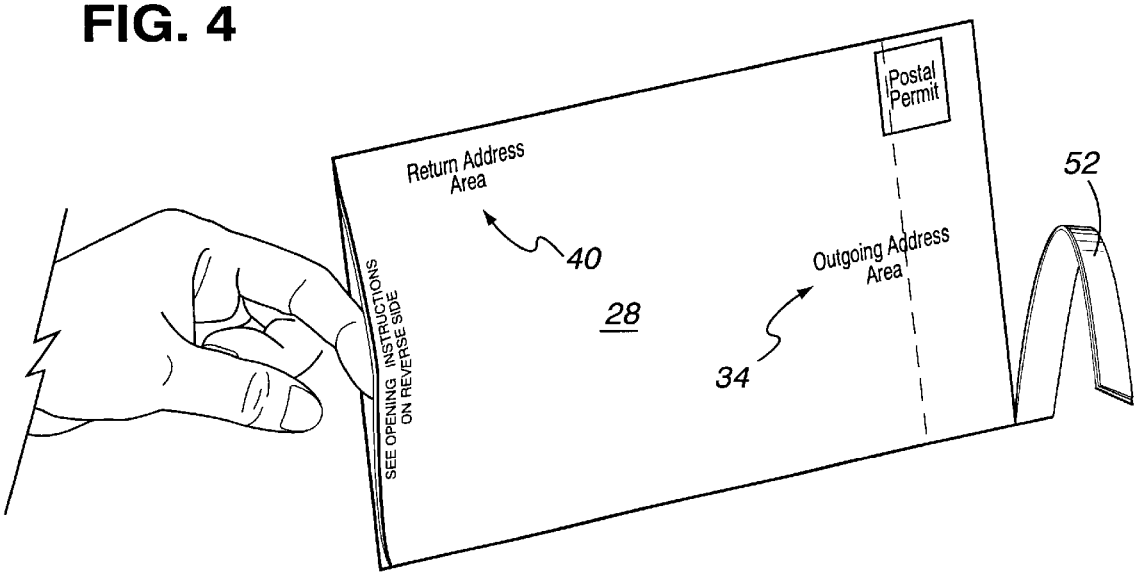
FIG. 4 is a perspective view showing the opening of the mailer of FIG. 3 by the end user.

First line of weakness 50 is formed in the first through third panels parallel to and spaced from the first side edge 16. The first line of weakness 50 defines tear off strip 52 providing for ready opening of one side of a mailer constructed by Z-folding the sheet of the intermediate about fold lines 24 and 26, as shown in FIG. 4.

The intermediate also includes a first line of demarcation 54 disposed parallel to the first side edge 16 and extending the majority of the dimension of the first and second panels 28, 30, parallel to side edge 16. The line of demarcation 54 passes through the outgoing address area 34 as seen in FIG. 1, and typically essentially bisects the outgoing address area. As seen in FIGS. 1 and 2 the first line of demarcation is closer to the first side edge 16 than to the second side edge 18, and defines a flap 90 in the first panel, and a flap 86 in the second panel between the line of demarcation 54 and the first line of weakness 50. The line of demarcation preferably comprises a second line of weakness (e.g. a perforated line), at least in the first panel.

Figure 3:
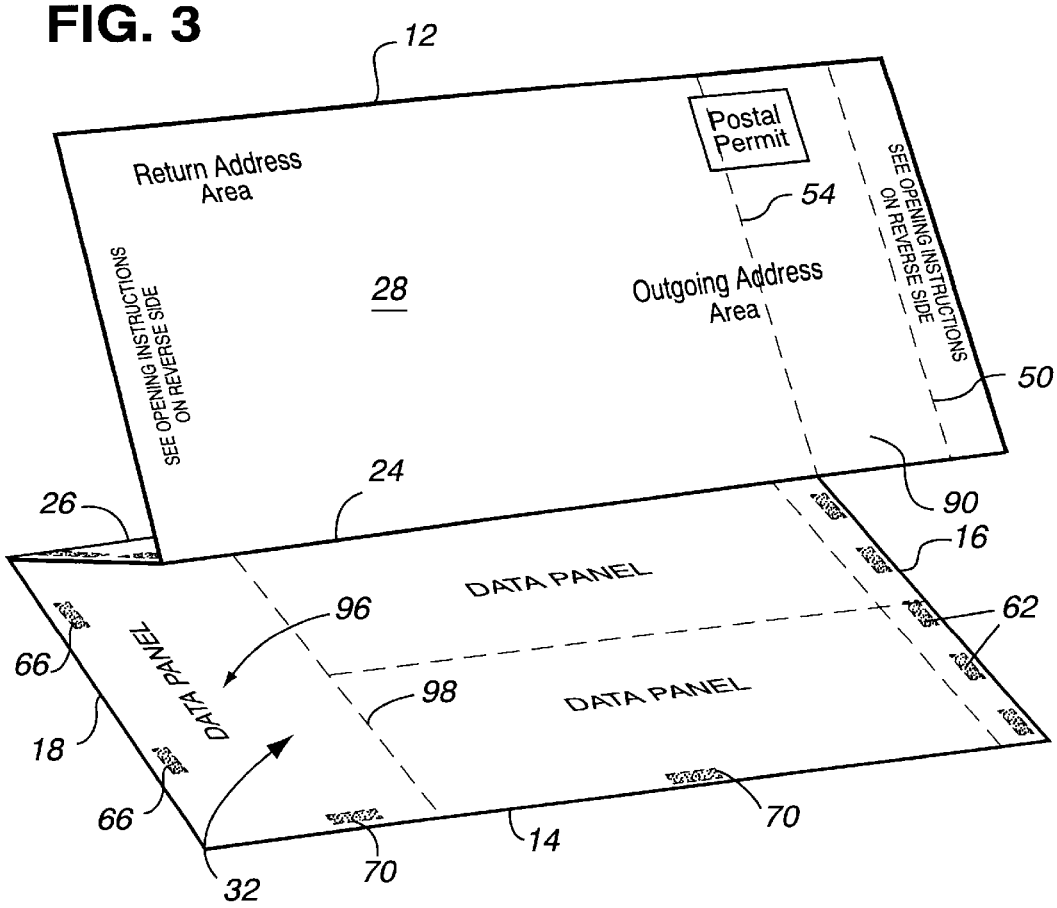
FIG. 3 is a top perspective view showing the intermediate of FIGS. 1 and 2 being folded into a mailer type business form.

The intermediate further comprises a first plurality of adhesive patterns provided along at least some of the edges of the panels for holding the first through third panels together in the outgoing mailer configuration when the sheet is Z-folded about the fold lines 24, 26, as illustrated in FIG. 3. In the preferred embodiment, illustrated in the drawings, the adhesive patterns include discontinuous strips 56, 58 provided on the second face of the first and/or second panels in tear off strip 52, discontinuous strips 60, 62 provided on the first face of the third and/or fourth panels 30, 32 in tear off strip 52 and discontinuous strips 64, 66 provided on the first face of the second and third panels.

The Z-fold adhesive patterns also preferably include one or more strips or segments for closing and adhering the bottom of the Z-folded mailer. Thus, in the illustrated embodiment, pressure seal cohesive 68, 70 is provided adjacent the first fold line 24 and adjacent the bottom edge 14 of the mailer for cooperating to adhere the second and third panels 30, 32 in the Z-fold configuration.

Most preferably, the adhesive for adhering the intermediate in the Z-fold mailer configuration is a substantially permanent adhesive that is defined by pressure seal adhesive or cohesive for sealing the mailer upon folding and the application of suitable pressure to the adhesive regions. In the alternative, however, the adhesive may be a re-wettable adhesive, pressure sensitive adhesive covered by a release strip. Also, the adhesive may be provided as continuous elements rather than discontinuous elements and/or in a pattern, shape or density other than that shown. Thus, the adhesive areas or patterns 56, 58, 60, 62, 64, 66, 68, 70 may take any configuration, not just dash line and discontinuous dot configurations as illustrated in FIGS. 1 and 2. However, it is preferred that the amount and spacing of such adhesive material be at least sufficient to allow the mailer to be processed by U.S. postal service automated systems.

Figure 5:
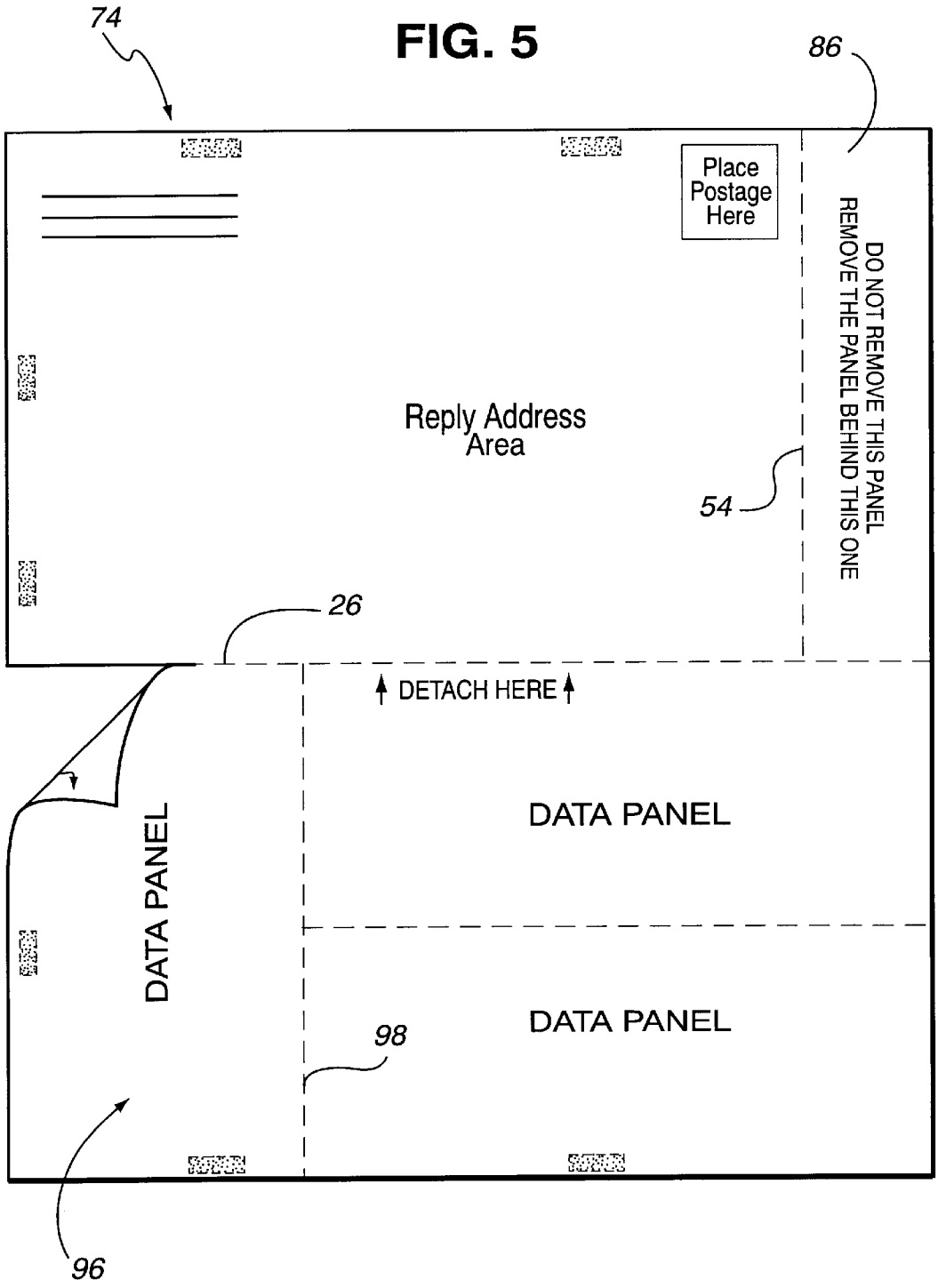
FIG. 5 is an exploded perspective view showing the removal of the statement or invoice and assembly of a reply envelope according to an exemplary embodiment of the invention.
Figure 6:
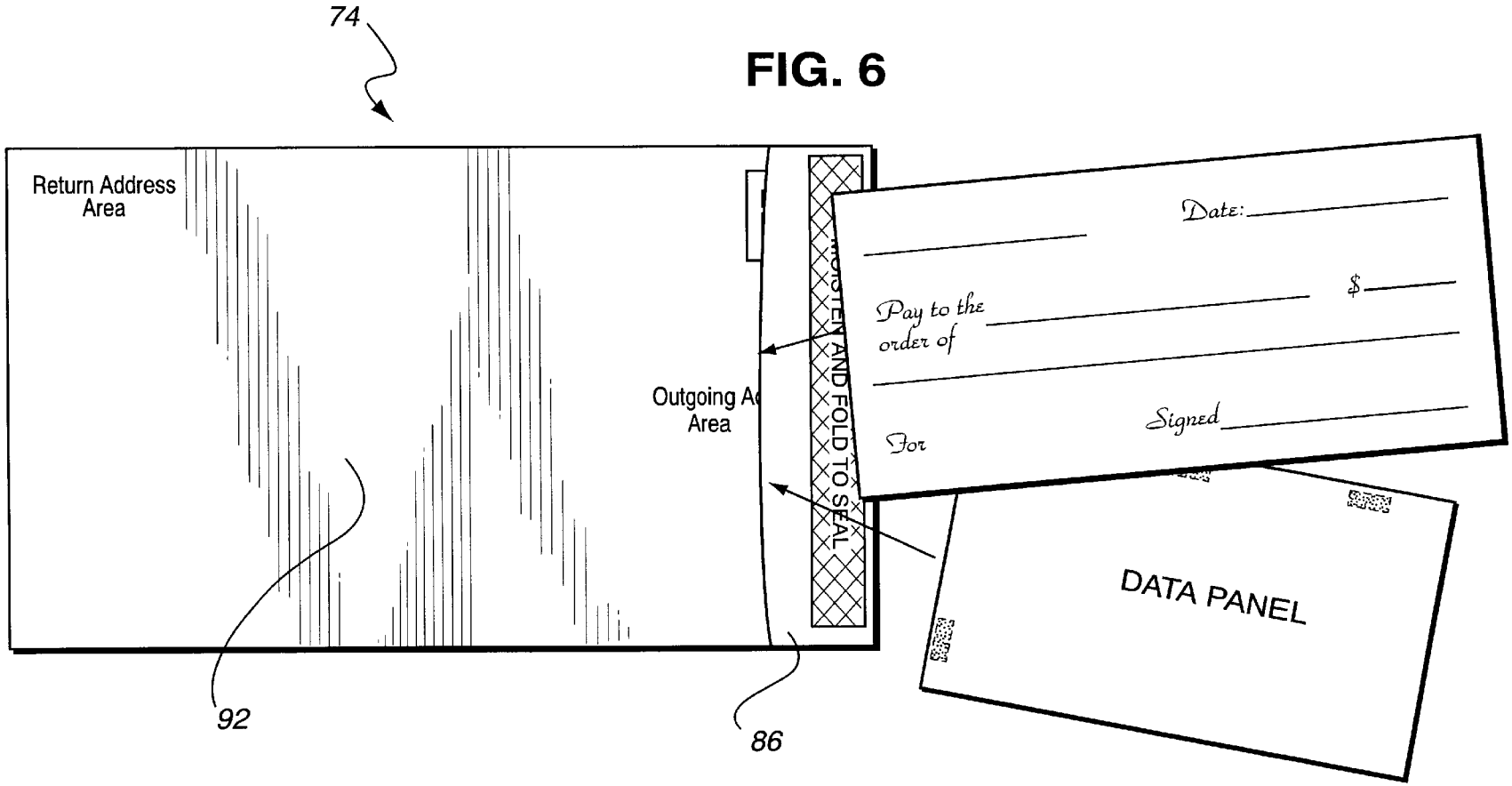
FIG. 6 is a perspective view showing the insertion of a check and remittance stub into the formed reply envelope.

Second permanent adhesive pattern(s) are further defined on the second face 22 of the intermediate 10 to define two of the panels into a reply envelope. In the illustrated embodiment, the first and second panels 28, 30 are adapted to define the reply envelope 74 (FIGS. 5 and 6). Thus, in the illustrated embodiment, a second adhesive pattern comprised of permanent adhesive areas 76, 78, 80, 82 is provided on the second face 22 of at least one of the first and second panels 28, 30. Because the first and second panels that define the reply envelope are joined at fold line 24, adhesive for defining the reply envelope is unnecessary along the second fold line, but may be provided as at 84.

While the patterns of adhesive 76, 78, 80, 82 are preferably permanent, pressure seal cohesive elements, this adhesive may instead be a re-wettable adhesive or may be a pressure sensitive adhesive that is covered and protected prior to sealing the reply envelope by a removable liner or the like. The adhesive areas or patterns 76, 78, 80, 82 may have variations in composition and configuration as described above with respect to areas 56, 58, 60, 62, 64, 66, 68, 70.

As will be appreciated from an examination of FIGS. 1 and 2, the sizing and spacing of the first and second adhesive patterns/areas 56, 58, 78, 82 on the second face, and the sizing and spacing of the first adhesive patterns/areas 60, 62, 64, 66 on the first face, these adhesive areas are respectively provided in consideration of one another so that when the intermediates are stacked one atop the other in advance of Z-folding, the adhesive patterns on the then facing first and second faces 20, 22 do not or do not substantially overlap. In this way, the intermediates can be stacked with minimal risk of the sheets adhering to one another. More specifically, it can be seen from FIGS. 1 and 2 that adhesive areas 58 are disposed to define spaces 59 therebetween which generally correspond in size and disposition to the size and disposition of adhesive areas 60, so that when intermediates 10 are stacked one upon the other with the second face of one sheet facing the first face of the next sheet, spaces 59 will be aligned with adhesive areas 60. Furthermore, it can be seen from FIGS. 1 and 2 that adhesive pattern/area 82 is discontinuously disposed to define spaces or gaps 81 between adhesive areas. Spaces 81 generally correspond in size and disposition to the size and disposition of adhesive areas 64, so that when intermediates 10 are stacked one upon the other with the second face of one sheet facing the first face of the next sheet, spaces or gaps 81 will be aligned with adhesive areas 64.

The intermediate of the invention is further adapted for use with a Print-To-Mail system, such as the HP Print-To-Mail system. The sealing mechanism within the HP Print-To-Mail system uses specific raised areas along a sealing roller/cylinder that apply pressure to the cohesive as the form passes through the rollers. The location of the raised areas is schematically shown in phantom in FIG. 2 adjacent top edge 12. As can further be seen from an examination of FIG. 2, the cohesive patterns or areas provided in the illustrated embodiment align with those raised areas. In particular, the cohesive strips 78, 82 used to create the end of the pasted pocket that defines the reply envelope 74 align with the outermost sealing segment (raised area) 72 on the sealing roller. This same segment 72 seals the adhesive 60, 62 provided in the margin 52 of the outgoing mail piece. Thus these adhesive areas are axially aligned so as to be sealed with a single sealing segment of the sealing system, but these adhesive areas do not cause blocking within the stack of cut sheet forms, due to the adhesive offset configuration.

In the same manner, other key components of the adhesive patterns/areas also align with the other segments (raised areas) on the sealing rollers for being compatible with the sealer and at the same time produces a mail piece that is also compatible with requirements set down by the US Postal Service for automated mail.

In the illustrated embodiment, no line of weakness is provided adjacent and parallel to the second side edge 18 and/or adjacent and parallel to the fold lines 24, 26 for defining tear off strips. Instead, only a single tear off strip 52 is defined along the first side edge 16 of the intermediate. This provides for a substantially larger area for creating the reply envelope and for providing printed indicia in general. Thus, the side 18 and bottom edge 14 of the Z-folded mailer are adapted to be open by an index finger and/or a letter opener rather than by removing tear off edges. Accordingly, it is preferable that the permanent cohesive 64, 66, 68, 70 for securing the third panel to the second panel in the Z-folded configuration be limited in number and dimensions so as to enable easy opening of the Z-folded mailer and limiting adhesive residue remaining on the thus separated panels. Accordingly, adhesive patterns 64, 66, 68, 70, are preferably provided discontinuously and widely spaced on the respective edges of the front face 20 of the second and third panels 30, 32 to facilitate disengagement of these edges by the end user with a letter opener or index finger, as shown in FIG. 4. Furthermore, the cohesive 64, 68 provided for example on the first face 20 of the mailer is preferably limited, as shown, as that portion of the mailer intermediate is retained as a part of the reply envelope. Similarly, in the illustrated embodiment, a portion of the cohesive 66, 70 will be retained on a part of the statement and thus is preferably minimized in dimension.

The second panel further comprises reply envelope closing flap 86, defined by first line of demarcation 54, which has an activatable adhesive 88 on the second face thereof for sealing the reply envelope. The first line of demarcation 54 may be a perforated line or die cut line or may be a scored or a crease line. Most preferably, the first line of demarcation 54 is a line of weakness (e.g. a perforated line), at least in the first panel, however, because a removable stub 90 is defined thereby in the first panel 28, to allow the reply envelope flap 86 to be adhered to the first face 20 of the first panel, which defines the rear panel of the reply envelope, as shown in FIG. 6. Preferably the portion of the first panel defining the rear panel 92 of the reply envelope has a transverse dimension not greater than and preferably slightly less than the transverse dimension of the front panel of the reply envelope.

Indicia may be printed wherever desired although at least with respect to the first face 20 of the first panel 28 and the first face 20 of the second panel 30 the printed indicia is preferably limited to address and postal indicia 36, 38, 40, 44, 46, 48. Various indicia and information may be printed on the first face 20 of the third panel 30 to instruct the end user to complete the remittance advice and as to the detachment of the statement portion of the mailer, and on the first face 20 of the first and second panels 28, 30 and the second face 22 of the first and third panels 28, 32 to instruct the end user on opening the Z-fold mailer and stub removal for forming the reply envelope. Other indicia may be provided as deemed necessary or desirable to instruct and direct the end user and/or as advertising, particularly on the second face 22 of the third panel 30.

The intermediate also preferably includes security screened areas (not shown) formed on the second face of those portions of the first and second panels that will form the interior of the reply envelope. The security screening may be screen printed by any conventional technique normally prior to the time that the intermediate is transported to the entity that will be printing the variable information on the intermediate (such as the outgoing address indicia, the reply address indicia, etc.).

Although not shown, detachable tractor drive strips may be provided for the intermediate during processing. Such strips are conventional for facilitating handling of the intermediate for printing or the like during manufacture of the mailer. Such strips are typically provided where the intermediate is in continuous form, wherein the top and bottom edges 12, 14 are lines of weakness between longitudinally adjacent intermediates 10. During normal processing, such strips (not shown) are slit off at an appropriate stage to expose the side edges 16, 18.

In constructing the mailer, after the intermediate 10 is detached from the adjacent intermediates continuously printed therewith (if any) and after slitting of any tractor drive edges (if provided), the intermediate is Z-folded as illustrated in FIG. 3 (typically by conventional folding equipment) and then is run through a suitable sealing machine (typically conventional equipment for either heat sealing or pressure sealing) for activating the adhesive patterns 56, 58, 60, 62, 64, 66, 68, 70, 76, 78, 80, 82, 84. Typically, the intermediate as seen in FIGS. 1 and 2 has a length between top and bottom edges 12, 14 of at least about 12 inches and more preferably about 14 inches to ensure that all postal specifications are met by both the mailer and the reply envelope. The reply envelope in the illustrated embodiment has a width of about 7½ inches so that it can easily receive a standard (6 inch in length) check therein without folding. In the illustrated embodiment, each panel has a length of about 4⅔ inches.

When the outgoing addressee receives the mailer, the panels then comprise first, second and third plies or panels 28, 30, 32 of the mailer with the second or bottom face 22 of the first panel 28 in face to face relation with the second or bottom face 22 of the second panel 30 and the first face or top face 20 of the second panel 30 in face to face relation with the first or top face 20 of the third panel 32. The mailer can be easily opened, as illustrated in FIG. 4, by tearing along line of weakness 50 and by disrupting the adhesive areas 64, 66 and 68, 70 along the side and bottom edges of the mailer with an index finger or letter opener. The resultant opened mailer is illustrated in FIG. 5.

The opened-up mailer has the third panel/ply 32 still primarily intact and connected by the fold line/line of weakness 26 to the reply envelope 74. In particular, looking at FIG. 4, the outgoing addressee can easily read the information when viewing the reply address indicia. As seen in FIG. 5, ultimately the third panel 32 is separated along the line 26 (as shown starting to separate at the left hand side of FIG. 5) and then the flap 90 is detached along the line of demarcation/weakness 54 of the first panel/ply 28 thereby exposing the activatable adhesive strip 88 on the reply envelope flap 86. Detaching the flap 90 tears the outgoing address indicia 36, and the width of the flap 86 is such that when it is folded over it substantially completely covers the remaining outgoing address indicia in area 34.

The end user then completes a remittance stub, for example data panel 96, and detaches it along the line of weakness 98 to define the remittance coupon. Once the remittance information has been completed, the check comprising the remittance is inserted into the reply envelope with the remittance coupon 96 through the open side thereof, as shown in FIG. 6. The reply envelope is then sealed by activating the adhesive 88, e.g., by wetting or removing a release strip (not shown) and applying the flap 86 to the front face 20 of the remaining portion 92 of the first panel 28.

The intermediate and mailer according to the present invention have a number of advantageous results. The reply envelope offers all needed postal encoding for fast delivery, and can be printer variable, and both the outgoing and reply addresses are printer variable. The reply envelope size allows for a remittance check to be inserted without having to fold it, and three possible removable panels are provided which may comprise customer copy, discount coupon, remittance stub, or any other suitable elements. Also numbering can be applied with either variable or at factory locations, so that a number appears on the outside of the reply envelope, outgoing envelope, and all removable panels.

It will thus be seen that according to the present invention a simple and easy to construct, print, and utilize mailer has been provided, having a large amount of printable area, due to the single tear of strip, and a reply envelope, which preferably can accept a six inch personal check without folding, without the need for a window or patch. Furthermore, the intermediate of the invention, having the foregoing characteristics, is compatible with print to mail systems as well as other sealing systems. In addition, the intermediate has adhesive patterns and areas that do not substantially overlap when the intermediates are stacked in advance of Z-folding, so that blocking of the sheets is avoided.

While the invention has been herein shown and described in what is presently conceived to be the most practical and preferred embodiment it will be apparent to those of ordinary skill in the art that many modifications may be made thereof within the scope of the present invention, which scope is to be accorded the broadest interpretation of the appended claims so as to encompass all equivalent intermediates and business forms.

What is claimed is:

1. An intermediate for a mailer type business form, comprising:

a quadrate sheet of paper having parallel top and bottom edges, parallel first and second side edges perpendicular to the top and bottom edges, and first and second faces;

first and second fold lines parallel to said top and bottom edges, and dividing said sheet into substantially equal size first, second, and third panels, an outgoing address area being defined on said first face of said first panel, said outgoing address area being spaced from said first and second side edges;

a reply address area being defined on said first face of said second panel, said reply address area being spaced from said first and second side edges;

a remittance area being defined on said first face of said third panel;

first line of weakness formed in said first, second and third panels, parallel to and spaced from said first side edge, said first line of weakness defining a tear-off strip providing for ready opening of a mailer constructed by Z-folding said sheet about said fold lines;

first adhesive areas provided at least in said tear-off strip for holding said first through third panels together as an outgoing mailer when said sheet is Z-folded about said fold lines; and second adhesive areas provided on said second face of said first and/or second panel for defining said first and second panels into a reply envelope that is substantially sealed along side and top and bottom edges thereof, wherein said sheet of paper is free from a line of weakness adjacent and parallel to said second side edge, thereby to maximize an available space of said first, second and third panels for printed indicia and to define said reply envelope.

2. An intermediate as recited in claim 1, wherein said first, second and third panels are free from a line of weakness adjacent and parallel to said top and bottom edges.

3. An intermediate as recited in claim 1, wherein said first panel is disposed between said top edge and said first fold line, said third panel is disposed between said bottom edge and said second fold line, and said second panel is disposed between said first and third panels.

4. An intermediate as recited in claim 3, wherein said second fold line is a line of weakness.

5. An intermediate as recited in claim 1, further comprising:

a first line of demarcation disposed parallel to said first line of weakness extending the majority of the dimension of at least said first and second panels parallel to said first line of weakness, said first line of demarcation being closer to said first line of weakness than to said second side edge, and defining a flap in each of said first and second panels between said first line of demarcation and said first line of weakness, said flap in said second panel defining a reply envelope closing flap; and a third adhesive area on said second face of said reply envelope closing flap for sealing the reply envelope along an end edge thereof.

6. An intermediate as recited in claim 5, wherein said third adhesive area comprises a rewettable adhesive.

7. An intermediate as recited in claim 5, wherein said reply envelope closing flap dimension from said first line of demarcation to said first line of weakness generally corresponds to or is greater than the dimension of said outgoing address area from said first line of demarcation toward said second side edge, so that when said reply envelope closing flap is folded about said first line of demarcation said second flap sealingly engages said first face of said first panel and said closing flap substantially completely covers any remaining portion of said outgoing address area.

8. An intermediate as recited in claim 1, wherein said first and second adhesive areas of said second face are longitudinally offset with respect to said first adhesive areas of said first face so that upon stacking with a second face of one intermediate disposed to overlie a first face of another intermediate with top edges aligned, said adhesive areas of said first and second faces will not substantially overlap.

9. An intermediate as recited in claim 1, wherein said first adhesive areas comprise a permanent adhesive.

10. An intermediate as recited in claim 1, wherein said first line of demarcation is a line of weakness in said first panel.

11. An intermediate as recited in claim 1, wherein the longest dimension of the interior of the reply envelope formed from said intermediate is at least about six inches, so that the reply envelope can receive an unfolded bank check therein.

12. An intermediate as recited in claim 1, further comprising human readable address indicia imaged in said outgoing address area.

13. An intermediate as recited in claim 1, wherein the distance between said top and bottom edges of the unfolded sheet is at least about twelve inches.

14. An intermediate as recited in claim 13, wherein the distance between said top and bottom edges of the unfolded sheet is about fourteen inches.

15. An intermediate as recited in claim 1, wherein said first permanent adhesive areas further comprise adhesive areas at spaced locations along at least one of a bottom edge of the top face of said third panel and a top end edge of the top face of said second panel.

16. A mailer type business form, comprising:

first, second, and third substantially equal size quadrate substantially opaque panels, said second panel being sandwiched between said first and third panels, and each panel having a top face and a bottom face, first and second side edges, and first and second end edges;

outgoing address indicia provided on said top face of said first panel;

reply address indicia provided on said top face of said second panel;

remittance stub indicia provided on said top face of said third panel;

a first line of weakness formed in said first, second and third panels, parallel to and spaced from said first side edge thereof, said first line of weakness defining a tear-off strip providing for ready opening of the mailer;

first permanent adhesive areas provided in said tear-off strip and at spaced locations along at least a portion of said second side edge holding said first through third panels together;

second permanent adhesive patterns provided on said bottom face of said first and second panels defining said first and second panels into a reply envelope that is substantially sealed along three edges thereof;

wherein said sheet of paper is free from a line of weakness adjacent and parallel to said second side edge, thereby to maximize an available space of said first, second and third panels for printed indicia and to define said reply envelope.

17. A mailer as recited in claim 16, further comprising:

a first line of demarcation disposed parallel to said first line of weakness extending the majority of the dimension of at least said first and second panels parallel to said first line of weakness, said first line of demarcation being closer to said first line of weakness than to said second side edge, and defining a flap in each of said first and second panels between said first line of demarcation and said first line of weakness, said flap in said second panel defining a reply envelope closing flap; and a third adhesive area on said second face of said reply envelope closing flap for sealing the reply envelope along an end edge thereof.

18. A mailer as recited in claim 16, wherein said first permanent adhesive areas further comprise adhesive areas at spaced locations along at least one of said second end edge of the top face of said third panel and said first end edge of the top face of said second panel.

19. A mailer as recited in claim 16, wherein said first, second and third panels are of paper, and wherein said first, second and third panels are connected together at mutually adjacent end edges as an integral sheet of paper.

20. An intermediate for a mailer type business form, comprising:

a quadrate sheet of paper having parallel top and bottom edges, parallel first and second side edges perpendicular to the top and bottom edges, and first and second faces;

first and second fold lines parallel to said top and bottom edges, and dividing said sheet into substantially equal size first, second, and third panels, an outgoing address area being defined on said first face of said first panel, said outgoing address area being spaced from said first and second side edges a reply address area being defined on said first face of said second panel, said reply address area being spaced from said first and second side edges;

a remittance area being defined on said first face of said third panel;

first line of weakness formed in said first, second and third panels, parallel to and spaced from said first side edge, said first line of weakness defining a tear-off strip providing for ready opening of a mailer constructed by Z-folding said sheet about said fold lines; and first adhesive areas provided in said tear-off strip for holding said first through third panels together as an outgoing mailer when said sheet is Z-folded about said fold lines; and second adhesive areas provided on said second face of said first and/or second panel for defining said first and second panels into a reply envelope that is substantially sealed along side and top and bottom edges thereof, a first line of demarcation disposed parallel to said first line of weakness extending the majority of the dimension of at least said first and second panels parallel to said first line of weakness, said first line of demarcation being closer to said first line of weakness than to said second side edge, and defining a flap in each of said first and second panels between said first line of demarcation and said first line of weakness, said flap in said second panel defining a reply envelope closing flap; and a third adhesive area on said second face of said reply envelope closing flap for sealing the reply envelope along an end edge thereof, wherein said first and second adhesive areas of said second face are longitudinally offset with respect to said first adhesive areas of said first face so that upon stacking with a second face of one intermediate disposed to overlie a first face of another intermediate with top edges aligned, said adhesive areas of said first and second faces will not substantially overlap.

21. An intermediate as recited in claim 20, wherein said sheet of paper is free from a line of weakness adjacent and parallel to said second side edge, and said first and third panels are free from a line of weakness adjacent and parallel to said top and bottom edges, thereby to maximize an available space of said first, second and third panels for printed indicia and to define said reply envelope.

22. An intermediate as recited in claim 20, wherein said first panel is disposed between said top edge and said first fold line, said third panel is disposed between said bottom edge and said second fold line, and said second panel is disposed between said first and third panels.

23. An intermediate as recited in claim 22, wherein said second fold line is a line of weakness.

24. An intermediate as recited in claim 20, wherein said reply envelope closing flap dimension from said first line of demarcation to said first line of weakness generally corresponds to or is greater than the dimension of said outgoing address area from said first line of demarcation toward said second side edge, so that when said reply envelope closing flap is folded about said first line of demarcation said second flap sealingly engages said first face of said first panel and said closing flap substantially completely covers any remaining portion of said outgoing address area.

* * * * *